US005380031A

United States Patent [19]

Vitali et al.

[11] Patent Number: 5,380,031

[45] Date of Patent: Jan. 10, 1995

[54] DEVICE FOR ASSEMBLING AN ACCESSORY ON A SKI

[75] Inventors: Hervé Vitali, Bonneville; Jean-Pierre Reynier, Rumilly, both of France

[73] Assignee: Salomon SA, Chavanod, France

[21] Appl. No.: 30,883

[22] Filed: Mar. 12, 1993

[30] Foreign Application Priority Data

Mar. 12, 1992 [FR] France ..... 92 03182

[51] Int. Cl.[6] ..... A63C 9/00

[52] U.S. Cl. ..... 280/611; 280/633; 411/360

[58] Field of Search ..... 280/611, 634, 617, 633, 280/636; 411/337, 352, 353, 360, 999

[56] References Cited

U.S. PATENT DOCUMENTS

| | | | |
|---|---|---|---|
| 3,917,300 | 11/1975 | Salomon | 280/611 |
| 4,640.524 | 2/1987 | Sedlmair | 280/611 |
| 4,747,613 | 5/1988 | Brichard et al. | 280/611 |
| 5,042,829 | 8/1991 | Sedlmair | 280/611 |
| 5,221,105 | 6/1993 | Mayr et al. | 280/611 |

*Primary Examiner*—Richard M. Camby
*Attorney, Agent, or Firm*—Pollock, Vande Sande & Priddy

[57] ABSTRACT

A device for assembling an accessory on a ski. The accessory comprises a base (13) designed to be placed on the ski surface and at least one hole (7) used to receive an assembly screw (1). The hole and the screw cooperate in such a way that, when the base (13) is placed on the ski, the screw is held in its hole and the screw tip protrudes beneath the surface of the base. The screw has, at its lower end, a threaded portion (4) having an outside-to-outside diameter (D) and a length (L), then, between this threaded portion (4) and the screw head (2), a smooth portion (3) having diameter (D') smaller than diameter (D) and a length (L'), and the hole (7) in the base comprises, in its upper part, a rotationally-generated cylindrical portion (9) having a diameter of between (D) and (D') and a height (H') clearly smaller than (L'), and, in its lower part, a portion (10) whose dimension, considered in cross-section in a horizontal plane, is greater than diameter (D) and whose height is less than (L).

9 Claims, 2 Drawing Sheets

DEVICE FOR ASSEMBLING AN ACCESSORY ON A SKI

FIELD OF THE INVENTION

The invention relates to a device for assembling an accessory, for example a binding, on a ski, in particular an alpine or cross-country ski.

BACKGROUND OF THE INVENTION

Accessories are normally assembled on a ski by means of screws. In general, the ski is preliminarily drilled with holes, for which the center distance of axes corresponds to that of the screws used to assemble the accessory in question. The accessory is placed in position on the ski, then the screws are tightened one by one.

In the past, screws were packaged separately from the bindings. The retailer was therefore obliged to open the bag of screws, place the screws in their respective holes, and screw them in one by one. The positioning of the binding on the ski, i.e., matching up the holes in the binding with the pre-drilled holes in the ski, was a complex operation, since it was done "blind," i.e., by trial and error.

French Patent Application No. 2 208 692 made known an assembly technique according to which the screws are held in place ready to be screwed into the base of the binding using a deformable position-retention device which holds them firmly in place. To facilitate the installation of the binding on the ski, the screws are held in place with the tip protruding beneath the lower surface of the binding. When the position of the binding on the ski matches the position determined by the holes pre-drilled in the ski, the tips of the screws fall into the holes, an occurrence which is easily sensed.

The technique described in this patent application requires the use of one or several elastically-deformable position-retention devices. These devices include, for example, an interface plate which is inserted between the lower surface of the binding and the upper surface of the ski, and deformable bushings embedded in the holes of the binding.

This technique can also be used without any additional position-retention device. Each screw is, in this case, held in place by the wall itself of the hole in the base, which can be made of a deformable material, e.g., a plastic material, or a non-deformable material, e.g., a metal-based alloy.

The problem then arises of ensuring with precision the placement of each screw in its hole, so that a well-determined length of the screw protrudes beneath the lower surface of the binding, in order to facilitate the installation of this binding on the ski.

In fact, since the screw is inserted in its hole by force, it is difficult to position it with precision on the production line, with the tip protruding beneath the lower surface of the binding and the head raised in relation to its housing.

This constraint causes problems on the production line itself, where the binding must be completely immobilized by its base so as to simulate disengagement and to control its operation. Imprecise placement of the screws can, in this case, hinder the operation of the elements which immobilize the base.

Furthermore, during mounting of the binding on the ski, if the screw is not sufficiently inserted in its hole and does not protrude sufficiently, installation of the binding on the ski will occur by trial and error, as before, and will be time-consuming for the retailer. If the length of the screw protruding beneath the lower surface of the binding is excessive, there is a risk of splintering the base of the binding during the screwing operation, since this screw holds, in localized fashion, the base raised in relation to the upper ski surface, while, when the other screws are tightened, they tend, on the contrary, to press the base down against the upper ski surface.

SUMMARY OF THE INVENTION

It is an object of the present invention to propose a device for assembling an accessory on a ski, this device making it possible to determine, with precision and repetitively, the screw length which protrudes beneath the lower surface of the ski.

Another purpose of the present invention is a object an assembly device which reduces the risk of splintering the bases when the different screws are tightened.

A further object of the invention is an assembly device which is compatible with different types of bases, i.e., one-piece bases or complex bases comprising a binding seating and an interface plate positioned beneath this seating.

Other objects and advantages of the invention will emerge during the following description, this description being provided, however, for informational, and not restrictive, purposes.

The assembly device according to the invention is designed for the assembly of an accessory on a ski, the accessory incorporating a base designed to be placed on the ski surface and at least one hole receiving a screw used for assembly to the ski, the hole and the screw cooperating by screw-pre-positioning means, so that, when the base is placed in the ski, the screw is held in place in its hole with the tip of the screw protruding beneath the surface of the base by a length l, for insertion in the ski-assembly hole. On its lower end, the screw has a threaded portion with an outside-to-outside diameter D' and a length L, then, between this threaded portion and the screw head, a smooth section having a diameter D' smaller than diameter D and a length L'. The upper portion of the hole in the base has, in a cylindrical part generated by revolution with a diameter between D and D', a height H' less than L' and, on its lower part, a part whose dimensions are greater than the diameter D and whose height is (L−l).

BRIEF DESCRIPTION OF THE DRAWINGS

The invention will be better understood by virtue of the following description and of the attached drawings, which form an integral part of it.

DESCRIPTION OF THE PREFERRED EMBODIMENTS

Figure 1:
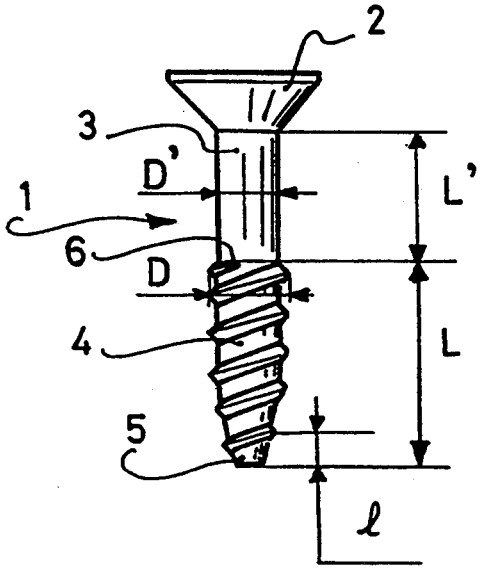
FIG. 1 is a side view of an assembly screw according to a first embodiment of the invention.

FIG. 1 illustrates a screw 1 having a head 2 and a body. The head 2 is of any suitable type; in the example shown, the head is countersunk. The screw body has a smooth upper portion 3 generated by cylindrical revolution having a length L', and, beneath this part, a threaded portion 4. The reference "L" designates the length of the threaded portion 4, and "l" the length of the threaded portion in the area of the screw tip, which will protrude beneath the lower surface of the accessory. An outside-to-outside diameter D of the threaded portion 4 is greater than the diameter D' of the smooth portion 3, so that a kind of shoulder 6 is formed between the two portions 3 and 4.

Good results have been obtained by providing a difference in diameter of more than 0.3 millimeter, and, in particular, a difference in diameter substantially equal to 0.5 millimeter.

Figure 2:
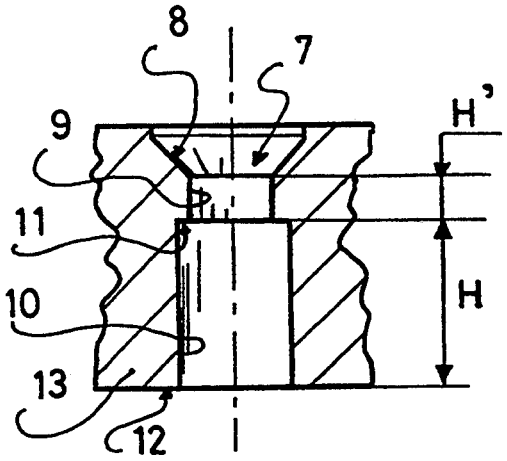
FIG. 2 is a transverse cross-section of a hole designed to cooperate with the screw in FIG. 1.

FIG. 2 is a cross-section, in a transverse, vertical plane, of the hole 7 in the base 13 of an accessory, which is designed to cooperate with the screw 1. The hole 7 comprises, from top to bottom, a countersunk recess 8 designed to cooperate with the head 2, then a portion 9 generated by cylindrical revolution, whose diameter ranges between the diameters D and D' of the portions 3 and 4 of the screw, and whose height H' is clearly shorter than the length L' of the smooth portion 3. The lower part of hole 7 incorporates a section 10 whose dimensions, seen in cross-section in a horizontal plane, are larger than those of the portion 9 and are also larger than the diameter D of the threaded portion 4. The two portions 9 and 10 are thus delimited by a shoulder 11. The height H of portion 10 is less than the length L of the threaded portion of the screw; and it is equal to length L minus the length l of the screw tip to be made to protrude beneath the lower surface 12 of the base 13.

The diameter of the portion 9 of the hole 7 depends on the deformable or non-deformable nature of the base 13. This diameter is always greater than the diameter D' of the smooth portion 3. If the base is made of a deformable material, e.g., a plastic material, the diameter of the part 9 can be equal to, or very slightly less or greater than, the outside-to-outside diameter D of the threaded portion 4. If the base is made of a non-deformable material, e.g., an aluminum alloy, the diameter of the portion 9 is equal to, or very slightly greater than, the outside-to-outside diameter D of the threaded portion 4.

Accordingly, the screw 1 can be inserted by force into the hole 7, so that the threaded portion 4 passes completely through portion 9 of the hole 7. This movement can be produced by vertical translational movement of the screw 1 along the longitudinal axis of the hole 7, by rotation, or by a combined translational and rotational movement.

This insertion causes the threaded portion 4 of the screw 1 to be lowered into portion 10 of the hole.

Since the diameter D' of the portion 3 is smaller than the diameter of portion 9 of the hole, the screw can thus slide along the longitudinal axis of the hole 7, over an amplitude equal to (L'−H').

Since, moreover, the diameter D of the threaded portion very closely approximates the diameter of portion 9, the screw cannot by itself come out of the hole 7. As the case dictates, the screw must be removed by force.

Figure 3:
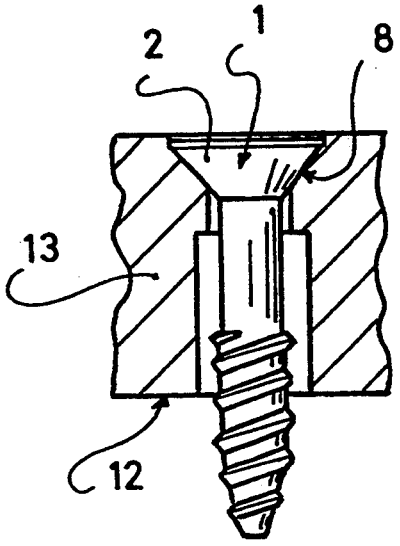
FIG. 3 shows the screw in its hole in the lowered position.
Figure 4:
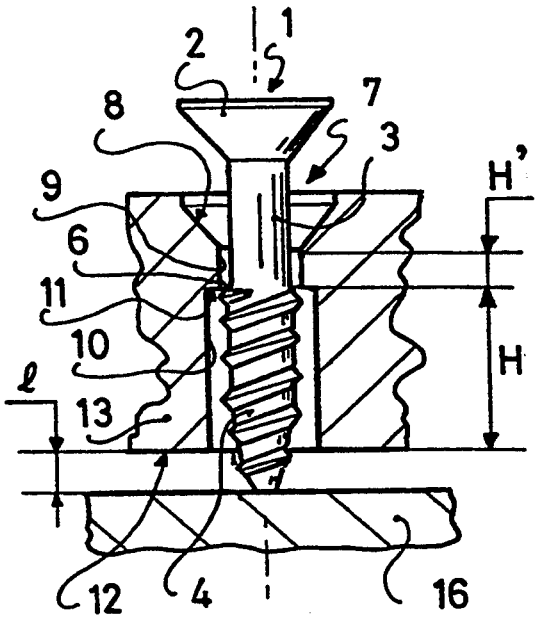
FIG. 4 shows the screw in raised position.

FIGS. 3 and 4 illustrate the two extreme positions of the screw in its hole 7. In FIG. 3, the screw is in the lowered position with the head 2 supported in its recess 8. In this position, the entire length of the screw 1 protruding beneath the lower surface 12 of the base 13 is preferably threaded. In other words, the length L' of the smooth portion 3 of the screw is shorter, and preferably substantially smaller, than the total height (H+H') of the hole 7.

FIG. 4 illustrates the screw 1 in its raised position, in which, the shoulder 6 separating the smooth and threaded zones of the screw 2 is in contact with the shoulder 11 between the portions 9 and 10 of the hole 7. The screw protrudes beneath the lower surface 12 of the base 13 over length l, and the screw head 2 is substantially removed from its receptacle 8.

Since a force fit exists between the diameter of the portion 9 of the hole 7 and the outside-to-outside diameter D of the threaded portion 4 of the screw, there is very little risk that, in this position, the screw will release itself from its hole 7.

Movement of the screw 1 from one position to the other occurs easily and naturally, e.g., by simple gravity. Movement from the lowered to the raised position of the screw can be effected equally simply by placing the binding, or the accessory, on a support such as a ski, which is shown schematically at reference 16.

The length l of the screw protruding beneath the lower surface 12 of the base 13 depends on the position of the shoulder 6 of the screw in relation to the shoulder 11 the hole.

In other words, the screw is held in place in the raised position in the hole 7 by virtue of the fact that the shoulder 6 of the screw abuts against the shoulder 11 of the hole. Because the diameter D of the threaded portion 4 of the screw is adjusted in relation to the diameter of the portion 10 of the hole 7, the screw cannot of itself move upward in the hole 7.

It is thus the mechanical stop means, rather than the manner of insertion, which determine the length l of the screw which projects beneath the lower surface of the accessory.

This length l is, in this way, controlled with precision and repetitively for each of the screws. As will be described below, use may be made of screws of different lengths l, in order to improve the screw-tightening conditions.

Good results have been obtained using screws whose projecting portion was between 1.5 and 3 millimeters, and preferably approximately 2.5 millimeters.

Figure 5:
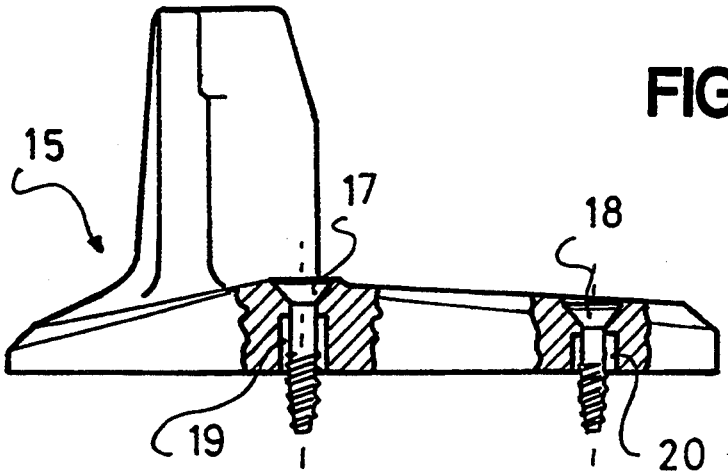
FIG. 5 illustrates the incorporation of the assembly device in the base of a binding.
Figure 6:
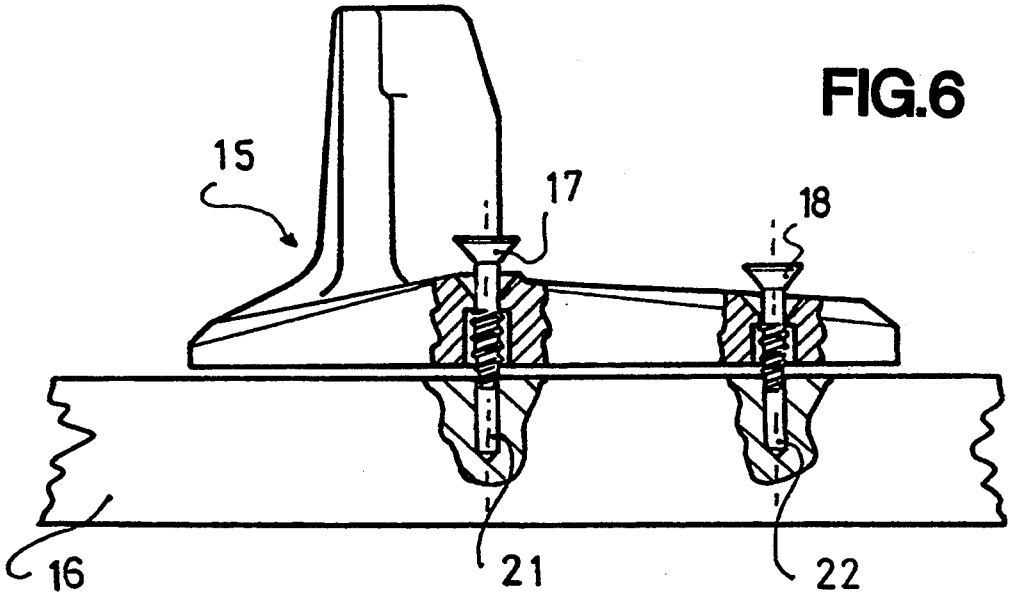
FIG. 6 illustrates the base of the binding in FIG. 5 in position on a ski.

FIGS. 5 and 6 illustrate, in side view and in partial cross-section, the base 15 of an alpine ski binding. In order not to complicate the Figure, only the base of this binding is shown. The base 15 is designed to be assembled on a ski 16 using screws 17 and 18 resembling screw 1 and inserted into the holes 19 and 20, which are similar to the holes 7 previously described.

This figure clearly shows that, depending on the thickness of the base in the area of the holes 19 and 20, the lengths L and L' of the screws 17 and 18 and the heights H and H' of the holes 19 and 20 may differ from one screw to the other.

FIG. 5 illustrates screws 17 and 18 in their lowered position. In FIG. 6, the base 15 is placed on a ski 16 in which holes 21 and 22 have been pre-drilled. As shown in this figure, the installation of the binding on the ski is facilitated by the insertion of the tips of the screws 17 and 18 into the holes 21 and 22.

According to a preferred embodiment, the length l of the threaded portion of a screw projecting beneath the lower surface of the base, or seating, can vary from one screw to the other. This length diminishes as a function of the sequence of tightening of the screws. Accordingly, the screws not yet tightened constitute only a limited, decreasing obstacle to pressing the base 15 against the ski surface, an operation which is effected by force by tightening the first screws.

Good results have been obtained using a length l of between 1.5 and 3 millimeters, and preferably between 1.5 and 2.5 millimeters.

Figure 7:
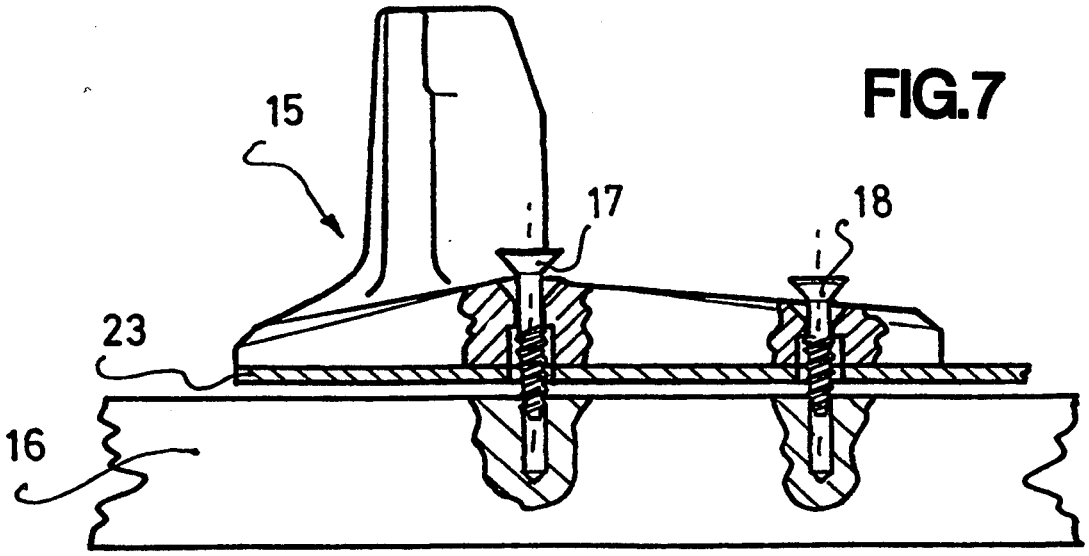
FIG. 7 illustrates a variant.

FIG. 7 illustrates a variant, in which the base of the accessory is complex and in which it is constituted by the seating 15 and a plate 23 fastened to the seating 15 beneath its lower surface. In this case, the plate 23 comprises holes to allow insertion of the screws, which have the same dimensions, or dimensions larger than that of portion 10 of the holes 7 described previously, i.e., whose dimensions, considered in horizontal cross-section, are substantially larger than the diameter D of the threaded portion 4 of the screws. Moreover, the thickness of the plate 23 is a factor in determining the lengths L and L′ of the threaded and smooth portions of the screws.

Of course, the present description is provided solely for informational purposes, and other applications of the invention could be made while remaining within its scope. In particular, it is obvious that the invention can encompass the assembly of any type of accessory to any kind of ski.

The smooth portion 3 of the screws, as well as portion 9 of the hole 7, may be tapered instead of being generated by cylindrical revolution. In other words, the diameter of portion 3 may decrease from the screw head to the threaded portion 4. Complementarily, portion 9 could have a diameter which decreases from top to bottom, so that the minimum diameter of this portion 9 is positioned in proximity to portion 10. When the screw is in the lowered position, a transverse cross-section of the screw gives a diameter less than, or equal to, that of the hole 9.

Furthermore, it may be added that the technique used to position the screws as previously described could be applied to a part only of the screws used to assemble the accessory.

The other screws could be pre-positioned using a conventional technique; i.e., these screws could be held firmly in place in their respective holes with the tip protruding slightly, or else flush with the lower surface of the accessory.

What is claimed is:

1. Device for assembling an accessory to a ski using at least one screw, said accessory comprising a base (13) provided with at least one assembly hole (7, 19, 20) adapted to receive a screw (1, 17, 18) used for assembly to said ski, said at least one assembly hole and said at least one screw cooperating by screw-pre-positioning means, so that, when said base is positioned on said ski, said at least one screw is held in place in said at lest one assembly hole with a tip of said at least one screw protruding beneath a lower surface (12) of said base by a first length (l), in order to be inserted in a second assembly hole (21, 22) provide in said ski, said at least one screw (1) having a threaded lower end portion (4) with a first outside-to-outside diameter (D) and a second length (L), then, between said threaded lower end portion and a head (2) of said at least one screw, a smooth portion (3) having a second diameter (D′) smaller than said first diameter (D) and a third length (L′), and said at least one assembly hole (7) in said base has an upper part comprising a portion (9) having a minimum diameter of between said first and second diameters (D, D′) and a height smaller than said third length (L′), and a lower part comprising a portion (10) having dimensions greater than said first diameter (D) and a height corresponding to said second length less said first length (L−l).

2. Device according to claim 1, wherein the diameter of said upper portion (9) of said hole (7) is slightly smaller than said outside-to-outside diameter (D) of said threaded lower end portion (4) of said screw (1).

3. Device according to claim 1, wherein said upper porion (9) of said hole (7) is rotationally generated and cylindrical and has a diameter equal to said outside-to-outside diameter of said threaded portion (4) of said screw (1).

4. Device according to claim 1, wherein said screw (1) incorporates, between said threaded portion (4) and said smooth portion (3) of said screw, a difference between diameters of more than 0.3 millimeter.

5. Device according to claim 1, wherein said upper portion (9) of said hole (7) is tapered and has a minimum diameter adjacent to said lower portion (10) of said hole.

6. Device according to claim 1 for an accessory (15) incorporating more than two assembly screws (17, 18) distributed at different points toward a front of said base, wherein the length (h) by which said screws (17, 18) protrude when said threaded portion (4) abuts against the shoulder (11) of said hole in said base differs from one screw to another.

7. Device according to claim 6, wherein said length (h) changes in decreasing fashion as a function of a screw-tightening sequence.

8. Device according to claim 1, wherein said base (13) comprises only a seating (15) for said accessory.

9. Device according to claim 1, wherein said base comprises a seating (15) for said accessory and an interface plate (18) fastened to said seating (15) beneath a lower surface of said seating.

* * * * *